US008321264B2

(12) United States Patent
Goldmann et al.

(10) Patent No.: US 8,321,264 B2
(45) Date of Patent: Nov. 27, 2012

(54) METHOD AND APPARATUS FOR DISPLAYING TOLL CHARGING PARAMETERS

(75) Inventors: Christian Goldmann, Zistersdorf (AT); Roland Aschenbrenner, Vienna (AT); Thomas Aschenbrenner, Vienna (AT)

(73) Assignee: Kapsch TrafficCom AG, Vienna (AT)

( * ) Notice: Subject to any disclaimer, the term of this patent is extended or adjusted under 35 U.S.C. 154(b) by 272 days.

(21) Appl. No.: 12/580,344

(22) Filed: Oct. 16, 2009

(65) Prior Publication Data

US 2011/0090095 A1 Apr. 21, 2011

(51) Int. Cl.
*G07B 15/00* (2011.01)
*G07B 15/02* (2011.01)

(52) U.S. Cl. ..... 705/13; 340/928; 340/905

(58) Field of Classification Search ..... 705/13; 340/937, 928, 933, 905; 382/105
See application file for complete search history.

(56) References Cited

U.S. PATENT DOCUMENTS 5,086,389 A * 2/1992 Hassett et al. ..... 705/13
5,101,200 A * 3/1992 Swett ..... 340/937
6,215,395 B1 * 4/2001 Slaughter et al. ..... 340/457.1
6,545,597 B1 * 4/2003 Blount ..... 340/425.5
6,587,755 B1 * 7/2003 Smith et al. ..... 701/1
7,375,648 B1 * 5/2008 Mulka et al. ..... 340/905
2004/0068433 A1 * 4/2004 Chatterjee et al. ..... 705/13
2005/0179563 A1 * 8/2005 Kelley ..... 340/928
2006/0015394 A1 * 1/2006 Sorensen ..... 705/13
2006/0044161 A1 * 3/2006 Feldman et al. ..... 340/933
2006/0056658 A1 * 3/2006 Kavner ..... 382/105
2006/0278705 A1 * 12/2006 Hedley et al. ..... 235/384
2007/0268140 A1 * 11/2007 Tang et al. ..... 340/572.4
2008/0143555 A1 * 6/2008 Allen et al. ..... 340/933
2008/0175438 A1 * 7/2008 Alves ..... 382/105
2009/0018761 A1 * 1/2009 Petrisor ..... 701/118
2010/0026465 A1 * 2/2010 Gravelle et al. ..... 340/10.1
2010/0085213 A1 * 4/2010 Turnock et al. ..... 340/928
2010/0106567 A1 * 4/2010 McNew et al. ..... 705/13
2010/0161392 A1 * 6/2010 Ashby et al. ..... 705/13
2010/0201505 A1 * 8/2010 Honary et al. ..... 340/425.5
2012/0143786 A1 * 6/2012 Karner ..... 705/400

* cited by examiner

*Primary Examiner* — John Hayes
*Assistant Examiner* — Brian Epstein
(74) *Attorney, Agent, or Firm* — Hoffmann & Baron, LLP

(57) ABSTRACT

The invention relates to methods and apparatus for displaying toll charging parameters of vehicles by means of a roadside display. In one embodiment, parameters are sent from an onboard-unit of the vehicle to the roadside display. In an alternative embodiment, parameters are registered under a vehicle identification in a database and retrieved therefrom for displaying on the roadside display by a detection of the identification of the vehicle.

22 Claims, 3 Drawing Sheets

METHOD AND APPARATUS FOR DISPLAYING TOLL CHARGING PARAMETERS

FIELD OF THE INVENTION

The present invention relates generally to vehicle toll charging and in particular to solutions for the enforcement of road pricing systems in which road tolls are charged depending on toll charging parameters set in an onboard-unit of a vehicle or registered in a database of the system.

BACKGROUND OF THE INVENTION

Modern road pricing systems often rely on characteristics of a vehicle or its mode of use, e.g. the number of occupants of the vehicle, as in case of high-occupancy vehicle (HOV) lanes or express lanes which single-occupant vehicles may be allowed to use by paying a toll. This concept is also known as a "high-occupancy toll" (HOT) lane system. The amount of HOT may be inversely proportional to the number of occupants of a vehicle: the higher the number of occupants, the lower the toll. Other variable road pricing concepts can rely on vehicle characteristics or classes of characteristics, e.g. number of axles or wheels, trailer presence, or its environmental (air or noise) pollution class.

In most automatic free-flow toll charging systems electronic onboard-units (OBUs) are installed in each vehicle. These OBUs can communicate with roadside equipment belonging to the toll charger, such as DSRC (dedicated short range communication) or WAVE (wireless access for vehicle environments) beacons. By means of such DSRC or WAVE beacons vehicles can be localized and their road usage determined, calculated and charged.

To implement usage and/or vehicle dependent road pricing systems as discussed above, e.g. HOT lane systems, some basic toll charging parameters usually have to be set in the onboard-units, for example the number of current occupants of the vehicle, the vehicle class of the vehicle, etc., or registered in a database of the system. In such scenarios, controlling and enforcing the correct setting or registering of toll charging parameters becomes a critical point: If users with false parameter settings or registrations could not be detected, the effectiveness of the entire system would be undermined.

At present, one means of controlling and enforcing parameter settings or registrations is the personal observation of vehicles passing by, be it directly or via a camera link, and the comparison of the observation results with toll transactions generated by the vehicles passing by. This is a time consuming process and not feasible for a larger road network. It has therefore also been proposed to use electronic image processing means with which e.g. the number of occupants of a vehicle is automatically determined in a camera picture of the vehicle by sophisticated object recognition techniques. However, windshield glare and the shadowing of rear passengers by front passengers in a car deteriorate the recognition result significantly so that such systems are not reliable enough for employment in a commercial system on a large scale.

OBJECTS AND SUMMARY OF THE INVENTION

It is therefore an object of the invention to provide a means for controlling and enforcing road pricing systems which are based on usage and/or vehicle specific toll charging parameters. It is a further object of the invention to devise a method for the enforcement of such road pricing systems on a large scale, e.g. countrywide, which is less burdensome. It is still a further object of the invention to provide an apparatus for implementing a simple, effective and easy-to-use enforcement regime for such road pricing systems.

In a first aspect of the invention these objects are achieved by means of a method of displaying toll charging parameters set in a toll charging onboard-unit of a vehicle, comprising the steps of:

- sending at least one toll charging parameter from the onboard-unit to a roadside display, and
- displaying said at least one parameter on the roadside display.

Preferably, the parameter is the number of occupants of the vehicle, in particular when the vehicle is traveling on a high-occupancy or express toll lane of the road.

Alternatively, the parameter may be a vehicle class of the vehicle.

The invention is particularly suited for wireless single or multilane free-flow toll charging systems, and preferably systems utilizing a DSRC, WAVE or infrared link.

In a second aspect of the invention the above mentioned objects are met with an apparatus for displaying toll charging parameters set in a toll charging onboard-unit of a vehicle, comprising:

- at least one onboard-unit including means for sending at least one of its toll charging parameters to a roadside display,
- wherein the at least one roadside display includes means for receiving and displaying said parameter.

The parameter is preferably the number of occupants of the vehicle, and, in particular, the road is preferably a high-occupancy or express toll lane.

Alternatively, the parameter may be a pollution class of the vehicle, e.g. indicating a hybrid car, which may be allowed to use HOT or HOV lanes even when occupied by only one person.

In a further preferred embodiment the onboard-unit and the roadside display establish a DSRC or WAVE link over which the parameter is sent.

In a third aspect the invention achieves its objects with a method of displaying toll charging parameters of a vehicle comprising the steps of:

- registering at least one toll charging parameter of the vehicle together with an identification of the vehicle in a database,
- detecting the identification of a vehicle and sending it to the database,
- retrieving at least one toll charging parameter for said identification from the database and sending it to a roadside display, and
- displaying said at least one parameter on the roadside display.

Preferably, the identification is written on a license plate of the vehicle and the detecting step is made by optical reading of the license plate.

Alternatively, the identification is stored in an electronic device of the vehicle and the detecting step is made by wireless communication with the electronic device.

It is of particular advantage if the detecting step is made using a DSRC, WAVE, RFID, or infrared link.

The registering step can preferably be made by means of a web portal of the database server or by means of a short message sent to the database server via a mobile phone network.

In a fourth aspect of the invention an apparatus for displaying toll charging parameters of a vehicle comprises:

a database for registering at least one toll charging parameter of the vehicle together with an identification of the vehicle, a detection and retrieval means for detecting the identification of a vehicle and retrieving at least one of the toll charging parameters registered under this identification from the database, and a roadside display for displaying said at least one parameter retrieved.

In a preferred embodiment the detection and retrieval means comprises a camera reading a license plate of the vehicle as the identification.

Alternatively, the detection and retrieval means comprises a wireless communication device reading an electronic identification tag of the vehicle as the identification.

According to a further preferred variant of the invention the wireless communication device establishes a DSRC, WAVE, RFID, or infrared link with the electronic identification tag.

Preferably, the database has an internet interface for entering registration data, or the database has a mobile phone network interface for receiving registration data sent by a short message over the mobile phone network.

The invention provides for a simple and very effective means for the enforcement of road pricing systems depending on toll charging parameters of vehicles. When a vehicle passes the roadside display, the parameters set in the OBU of the vehicle or registered in the database of the system are publicly displayed on the roadside display and thus readily readable by the driver as well as any person in the vicinity of the roadside display, e.g. toll enforcement officers, other drivers or passers-by who can contribute to the enforcement. Discrepancies between the parameters displayed on the roadside display and the actual characteristics of the vehicle or its mode of use are thus easily detected. In addition, a public display of parameters set in an OBU or registered in a database has an educating effect on all drivers to correctly set or register their toll charging parameters.

BRIEF DESCRIPTION OF THE DRAWINGS

These and other objects, benefits and features of the invention are now described by means of preferred embodiments thereof with reference to the enclosed drawings in which.

DETAILED DESCRIPTION OF THE PREFERRED EMBODIMENTS

Figure 1:
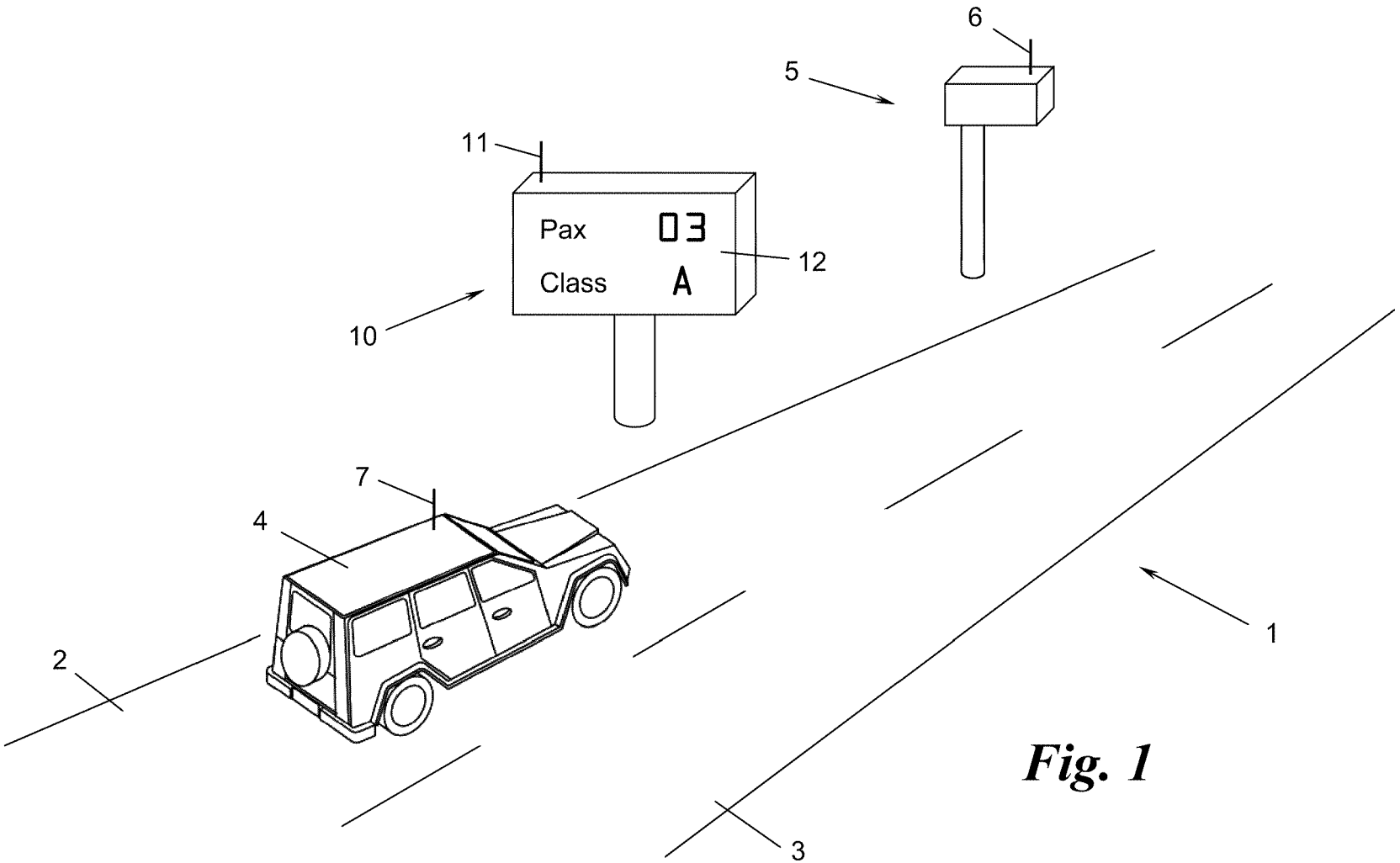
FIG. 1 shows the apparatus and method of the invention in a schematic perspective view of a section of a road equipped therewith.

FIG. 1 shows a section of a road 1 with two lanes 2, 3, the lane 2 of which is a HOT (high occupancy toll) lane. HOT lane 2 is subject to a road toll depending on the number of occupants of a vehicle 4 using this lane. To charge this toll, a wireless free-flow toll charging system 5 is used, an exemplary radio frequency beacon 6 of which is shown. The toll charging system 5 is comprised of a plurality of beacons 6 connected to a toll charging control center (not shown).

Figure 2:
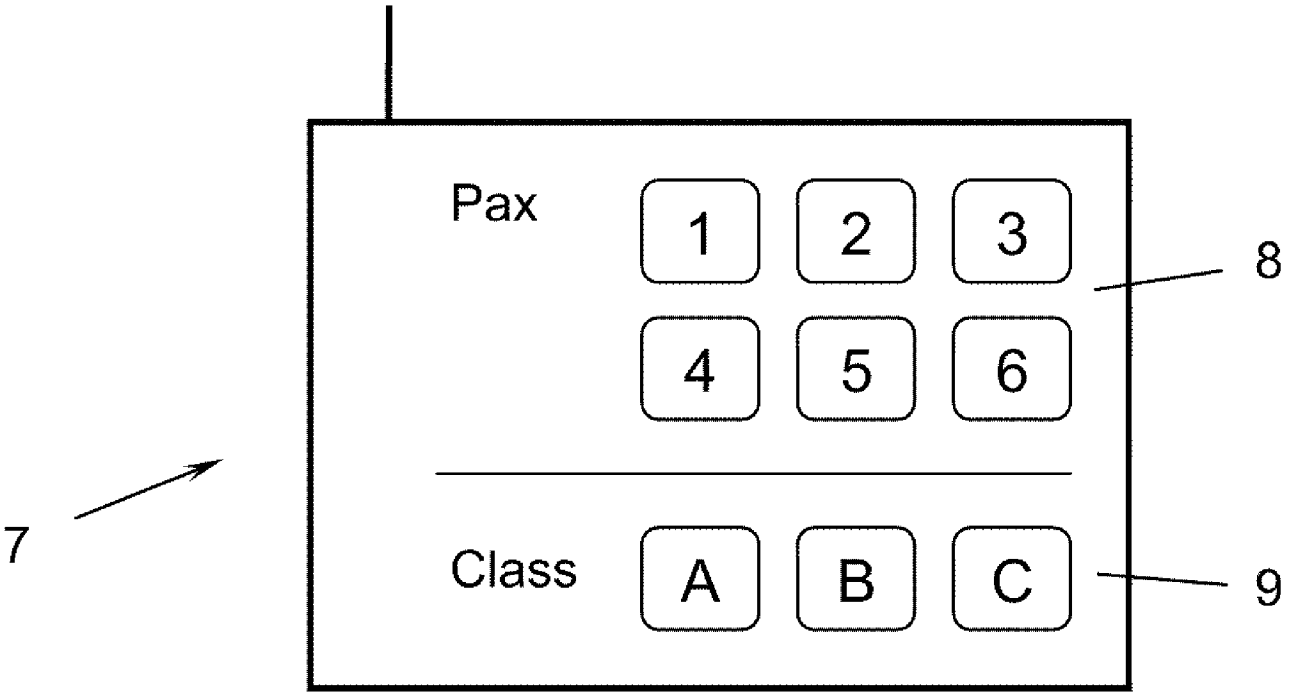
FIG. 2 shows an embodiment of an onboard-unit for use in the method and apparatus of FIG. 1.

All vehicles participating in the toll charging system 5, such as the vehicle 4, are equipped with an onboard-unit (OBU) 7 (see also FIG. 2). The OBU 7 can communicate with beacons 6 along the road 1, thereby generating toll charging transactions in the toll charging system 5.

The wireless communication link between the beacons 6 and the OBUs 7 is preferably a DSRC (dedicated short range communication) or WAVE (wireless access for vehicle environments) link.

As shown in FIG. 2, OBU 7 comprises first and second keyboards 8, 9 for entering (setting) toll charging parameters of the OBU 7 which form the basis for calculating the toll in the toll charging system 5. In the case of HOT lane 2, these parameters are e.g. the number of occupants of the vehicle 4, which can e.g. be simply set by pushing the button with the correct number of occupants on a keyboard 8. In other road pricing applications other characteristics of the vehicle or its mode of use can be used as toll charging parameters such as e.g. a vehicle class of the vehicle, the noise or air pollution class of the vehicle, the horsepower rating of the vehicle, the number of wheels or axles of the vehicle etc., and be set by respective buttons on a keyboard 9 of the OBU 7.

It should be noted that the toll charging parameters in question need not necessarily be entered by hand into OBU 7 but could also be stored or programmed into OBU 7 during its manufacture or distribution to customers. The toll charging parameters could also be pre-programmed, and for each specific setting of toll charging parameters, a different pre-set OBU 7 could be manufactured or distributed. Alternatively, the toll charging parameters could also be downloaded onto OBU 7 via any suitable electronic interface by the user, manufacturer or distributor.

Returning to FIG. 1, along the road 1 there is provided a roadside display 10 capable of receiving and displaying toll charging parameters set in an OBU 7 of a vehicle 4 passing by. The sending of the toll charging parameters from an OBU 7 to the roadside display 10 can be made in any suitable form, e.g. by periodic or continuous broadcasts of parameters by OBUs 7 passing by or upon requests from the roadside display 10 to OBUs 7 passing by.

For the sending of the parameters from the OBU 7 to display 10, the same sort of communication link can be used as for the toll charging communication of OBUs 7 with the toll charging system 5. In particular, the same DSRC or WAVE link as used for the communication between OBUs 7 and beacons 6 may be used to send the parameters from the OBU 7 to the display 10. To this end, the roadside display 10 preferably includes DSRC or WAVE communication equipment 11 therein. Alternatively, the roadside display 10 could use the communication equipment of the beacons 6, or, if necessary, a completely different communication link could be established between display 10 and OBUs 7.

The roadside display 10 displays the toll charging parameters received from the OBUs 7 in a prominent way, e.g. on a large screen or data field 12 on the front of the display 10. In the embodiment shown in FIGS. 1, 2 and 3 discussed later on, the number of passengers ("Pax") set in the OBU 7 by means of the keyboard 8 is displayed as "03", and the pollution class of the vehicle 4 as set in the OBU 7 by means of the keyboard 9 is displayed as "A".

In this way, occupants of the vehicle 4 themselves, enforcement officers reading the roadside display 10, as well as any other drivers, pedestrians or passers-by can read the parameter(s) on the roadside display 10 and compare it with the actual appearance and characteristics of the vehicle 4 or its mode of use, e.g. its occupants or use of lanes, which makes detection of toll fraud very simple, easy and effective.

Figure 3:
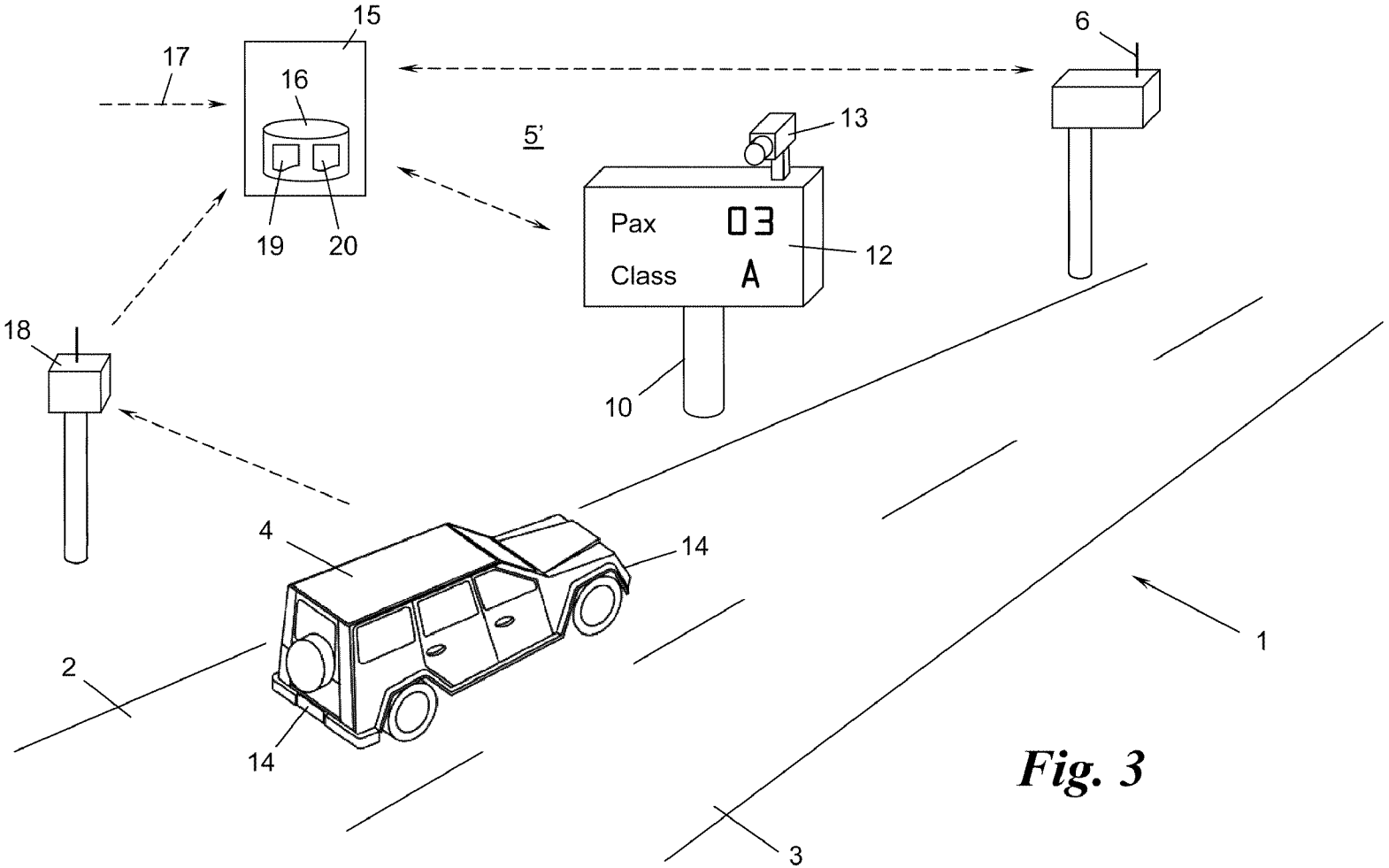
FIG. 3 shows a further embodiment of the apparatus and method of the invention in a schematic perspective view of a section of a road equipped therewith.

FIG. 3 shows an alternative embodiment of the method and apparatus of the invention. In this embodiment, a camera based toll charging system 5' is used comprising at least one camera 13 reading the license plate number on a license plate 14 of the vehicle 4 as an identification of the vehicle 4. Based on this identification of the vehicle 4 and the known location of the camera 13 a toll can be calculated and charged in a toll charging control center 15.

The camera 13 can be a video camera or a photographic (still) camera. The license plate read by the camera 13 can be processed by e.g. optical character recognition in order to extract the license plate number.

Instead of an optical identification of the vehicle 4, the toll charging system 5' could also implement an electronic identification of the vehicle 4, e.g. by means of the beacons 6 which communicate wirelessly with an electronic identification tag within the vehicle 4. The electronic identification tag can e.g. be the OBU 7, an RFID (radio frequency identification) tag mounted in or on the vehicle 4, or any other machine-readable medium which can carry an identification of the vehicle.

In the toll charging system 5' of FIG. 3 users have to register their vehicle 4 with a central database 16 before using the system. In particular, in the database 16 one or more toll charging parameters of a vehicle 4 are registered together with the identification of the vehicle such as its license plate number, OBU or RFID identification, etc. The registration step can be made e.g. over a web portal 17 of the database 16 via the Internet from a user terminal (a PC, mobile phone, handheld device, etc.) or by means of a short message (SMS) sent from a mobile phone over a mobile phone network 18 to the database 16.

The toll charging parameters registered in the database 16 can be any one or more of the toll charging parameters mentioned above. In addition, they could also indicate a status of the vehicle 4 in a specific list, e.g. the inclusion of the vehicle in a "black list" 19 featuring invalid identifications of e.g. fraudulent users or defective OBUs or in a "white list" 20 featuring vehicles with special rights of road use.

Attributed and connected to the roadside display 10 is at least one of the cameras 13 and/or beacons 6 in order to detect the identification of a vehicle 4 passing by the roadside display 10. Based on the identification detected, the corresponding toll charging parameter is retrieved from the database 16 and displayed on the screen 12 of the roadside display 10.

The database 16 can be located within the toll charging center 15 or any other part of the system, e.g. within the camera 13, the beacon 6 or the roadside display 10 itself.

The means for detecting the identification of a vehicle such as the camera 13 or the beacon 6 can be integrated into the roadside display 10 or installed separately. The camera 13 can be a camera dedicated specifically for the purpose of detecting the identification or can be one of the existing cameras of a camera based toll charging system. The means for retrieving the toll charging parameters from the database 16 can be implemented within the roadside display 10, the detecting means 6, 13, the database 16 itself, or in a separate component of the system.

In all embodiments, the roadside display 10 can be mounted along or above the road 1, e.g. on a pole, beam or bridge, both separately as well as together with a beacon 6 or camera 13. Furthermore, the roadside display 10 need not be stationary as has been shown in FIGS. 1 and 3 but could alternatively be a portable device, e.g. for temporary installation along the road 1.

The parameters displayed on the roadside display 10 can be stored within the roadside display 10 and/or the database 16 for documentation and enforcement purposes, if necessary.

The area of the road 1 or lanes 2, 3 where the vehicle is identified and/or its toll charging parameters are read out can be marked specifically, e.g. by a coloring on the road, in order to inform the driver of the roadside display.

The following features of the invention can be used in any possible combination within the framework of the above-cited aspects of the invention:

said toll charging parameter(s) can be the number of occupants of the vehicle and/or a vehicle class of the vehicle and/or a list status of the vehicle;

said sending between the onboard-unit and the roadside display and/or said detecting of the vehicle identification can be made using a DSRC, WAVE, RFID or infrared link;

said registering step can be made by means of a web portal of the database server and/or by means of a short message sent to the database server via a mobile phone network;

said identification can be written on a license plate of the vehicle and said detecting step be made by optical reading of the license plate, and/or said identification can be stored in an electronic device of the vehicle and said detecting step be made by wireless communication with the electronic device.

The invention is thus not limited to the preferred embodiments disclosed herein but encompasses all variants and modifications thereof which fall into the scope of the appended claims.

What is claimed is:

1. A method of displaying toll charging parameters set in a toll charging electronic onboard-unit provided in a vehicle, the method comprising:

sending, using the electronic onboard-unit, at least one toll charging parameter from the electronic onboard-unit to an automated, publically viewable roadside display monitor; and displaying said at least one parameter on the roadside display monitor, wherein said parameter is a numeric value representing a count of the number of occupants of the vehicle, said at least one parameter on the roadside display monitor being visible to an occupant of the vehicle, enforcement officers, other drivers and passers-by.

2. The method of claim 1, wherein the vehicle is traveling on a high-occupancy or express toll lane, and wherein the roadside display monitor comprises a large sign for displaying the toll charging parameters.

3. The method of claim 1, wherein said parameter includes a vehicle class of the vehicle.

4. The method of claim 1, wherein said parameter includes a status of the vehicle registered in a database list.

5. The method of claim 1, wherein the sending step is made using a DSRC, WAVE, RFID or infrared link.

6. An apparatus for displaying toll charging parameters set in a toll charging onboard-unit of a vehicle comprising:

at least one onboard-unit including means for sending at least one of its toll charging parameters to at least one publically viewable roadside display monitor;

wherein the at least one roadside display monitor includes means for receiving and displaying said parameter thereon, wherein said parameter is a numeric value representing a count of the number of occupants of the vehicle, said parameter on the roadside display monitor being visible to an occupant of the vehicle, enforcement officers, other drivers and passers-by.

7. The apparatus of claim 6, wherein the vehicle is traveling on a high-occupancy or express toll lane, and wherein the roadside display monitor comprises a large sign for displaying the toll charging parameters.

8. The apparatus of claim 6, wherein said parameter includes a vehicle class of the vehicle.

9. The apparatus of claim 6, wherein the means for sending and the means for receiving said parameter is a DSRC, WAVE, RFID or infrared link established between the onboard-unit and the roadside display.

10. A method of displaying toll charging parameters of a vehicle comprising:

registering at least one toll charging parameter of the vehicle together with an identification of the vehicle in a database, detecting the identification of a vehicle and automatically sending said identification using a first electronic device to the database, retrieving at least one toll charging parameter for said identification from the database and automatically sending said at least one toll charging parameter using a second electronic device to a publically viewable roadside display monitor, and displaying said at least one parameter on the roadside display monitor, wherein said at least one parameter is a numeric value representing a count of the number of occupants of the vehicle, said at least one parameter on the roadside display monitor being visible to an occupant of the vehicle, enforcement officers, other drivers and passers-by.

11. The method of claim 10, wherein said identification is written on a license plate of the vehicle and said detecting step is made by optical reading of the license plate.

12. The method of claim 10, wherein said identification is stored in an electronic device of the vehicle and said detecting step is made by wireless communication with the electronic device.

13. The method of claim 12, wherein said detecting step is made using a DSRC, WAVE, RFID, or infrared link.

14. The method of claim 10, wherein said registering step is made by means of a web portal of the database server.

15. The method of claim 10, wherein said registering step is made by means of a short message sent to the database server via a mobile phone network.

16. The method of claim 10, wherein said parameter includes a vehicle class of the vehicle.

17. An apparatus for displaying toll charging parameters of a vehicle, comprising:

a database for registering at least one toll charging parameter of the vehicle together with an identification of the vehicle, a detection and retrieval device for detecting the identification of a vehicle and retrieving at least one of the toll charging parameters registered under this identification from the database, and a publically viewable roadside display monitor for displaying said at least one parameter retrieved, wherein said at least one parameter is a numeric value representing a count of the number of occupants of the vehicle, said at least one parameter on the roadside display monitor being visible to an occupant of the vehicle, enforcement officers, other drivers and passers-bv.

18. The apparatus of claim 17, wherein said detection and retrieval device comprises a camera reading a license plate of the vehicle as said identification.

19. The apparatus of claim 17, wherein said detection and retrieval device comprises a wireless communication device reading an electronic identification tag of the vehicle as said identification.

20. The apparatus of claim 19, wherein said wireless communication device establishes a DSRC, WAVE, RFID, or infrared link with the electronic identification tag.

21. The apparatus of claim 17, wherein said database has an internet interface for entering registration data.

22. The apparatus of claim 17, wherein said database has a mobile phone network interface for receiving registration data sent by a short message over the mobile phone network.

* * * * *